US012108808B2

(12) United States Patent
Costanzo et al.

(10) Patent No.: US 12,108,808 B2
(45) Date of Patent: Oct. 8, 2024

(54) EXTRACTOR FOR AN AEROSOL-GENERATING DEVICE

(71) Applicant: Philip Morris Products S.A., Neuchatel (CH)

(72) Inventors: Domenico Costanzo, Bologna (IT); Mirko Minzoni, Neuchatel (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 506 days.

(21) Appl. No.: 17/312,624

(22) PCT Filed: Dec. 12, 2019

(86) PCT No.: PCT/EP2019/084949
§ 371 (c)(1),
(2) Date: Jun. 10, 2021

(87) PCT Pub. No.: WO2020/126846
PCT Pub. Date: Jun. 25, 2020

(65) Prior Publication Data

US 2022/0015455 A1 Jan. 20, 2022

(30) Foreign Application Priority Data

Dec. 17, 2018 (EP) ..... 18213177
Jun. 10, 2019 (EP) ..... 19179271

(51) Int. Cl.
*A24F 40/85* (2020.01)
*A24F 40/42* (2020.01)
*A24F 40/46* (2020.01)

(52) U.S. Cl.
CPC ..... *A24F 40/85* (2020.01); *A24F 40/42* (2020.01); *A24F 40/46* (2020.01)

(58) Field of Classification Search
CPC ..... A24F 40/85; A24F 40/46; A24F 40/42
(Continued)

(56) References Cited

U.S. PATENT DOCUMENTS 5,144,962 A 9/1992 Counts et al.
11,641,878 B2 * 5/2023 Li ..... A24F 40/40 131/329
(Continued)

FOREIGN PATENT DOCUMENTS

CN 107205494 A 9/2017
CN 107594635 A 1/2018
(Continued)

OTHER PUBLICATIONS

International Search Report and Written Opinion issued on Jun. 22, 2020 in PCT/EP2019/084949 filed on Dec. 12, 2019.
(Continued)

*Primary Examiner* — Gary F Paumen
(74) *Attorney, Agent, or Firm* — Oblon, McClelland, Maier & Neustadt, L.L.P.

(57) ABSTRACT

An extractor for extracting an aerosol-forming substrate from an aerosol-generating device is provided, the extractor including: a first component configured to connect to the aerosol-generating device, the first component including a base and one or more side walls extending from the base to define a cavity configured to receive an aerosol-forming substrate; and a second component configured to connect to the first component, the second component defining a cylindrical cavity or a circular aperture configured to receive a mouthpiece article for the aerosol-generating device. An aerosol-generating device comprising the extractor, and a system comprising the extractor, are also provided.

16 Claims, 4 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2014/0288454 | A1* | 9/2014 | Paz | A61B 5/4845 600/532 |
| 2015/0013696 | A1* | 1/2015 | Plojoux | A61M 15/06 131/328 |
| 2018/0007972 | A1* | 1/2018 | Thorens | A61M 11/003 |
| 2018/0007973 | A1* | 1/2018 | Thorens | A61M 11/003 |
| 2018/0007974 | A1* | 1/2018 | Thorens | A61M 15/003 |
| 2018/0015237 | A1* | 1/2018 | Thorens | A61M 11/042 |
| 2018/0049472 | A1* | 2/2018 | Mahler | A24F 40/46 |
| 2018/0228216 | A1 | 8/2018 | Saygili | |
| 2020/0060351 | A1* | 2/2020 | Thorens | A24D 1/20 |
| 2020/0093183 | A1 | 3/2020 | Zheng et al. | |

FOREIGN PATENT DOCUMENTS

| | | | |
|---|---|---|---|
| CN | 107690288 | A | 2/2018 |
| CN | 108185538 | A | 6/2018 |
| CN | 108402526 | A | 8/2018 |
| CN | 207912057 | U | 9/2018 |
| CN | 108618205 | A | 10/2018 |
| EP | 3 000 335 | A1 | 3/2016 |
| JP | 2014-533513 | A | 12/2014 |
| JP | 2018-528788 | A | 10/2018 |
| RU | 2 620 491 | C2 | 5/2017 |
| WO | WO 2013/076098 | A2 | 5/2013 |
| WO | WO 2016/124550 | A1 | 8/2016 |
| WO | WO 2016/193147 | A1 | 12/2016 |
| WO | WO 2017/207586 | A1 | 12/2017 |
| WO | WO 2019/021119 | A1 | 1/2019 |

OTHER PUBLICATIONS

Combined Russian Office Action and Search Report issued Mar. 24, 2023 in Russian Application 2021119541, (with English translation), 12 pages.
Extended European Search Report issued Sep. 27, 2019 in European Patent Application No. 18213177.1, 10 pages.
Extended European Search Report issued Mar. 11, 2020 in European Patent Application No. 19179271.2, 11 pages.
Tvape, "V2 Pro Series 7 Tutorial," Youtube, Retrieved from the Internet [URL: https://www.youtube.com/watch?v=1G8ftKRRAA8&t=128s], 1 page.
Combined Chinese Office Action and Search Report issued on Oct. 8, 2023 in Chinese Patent Application No. 201980077371.0 (with unedited computer-generated English translation), 15 pages.
Japanese Office Action issued Dec. 21, 2023 in Japanese Patent Application No. 2021-530244 (with English Translation), 10 pages.
Chinese Office Action and Search Report mailed on Mar. 3, 2024, issued in Chinese Patent Application No. 201980077371.0 filed on Dec. 12, 2019, with English Translation, total 16 pages.
Japanese Office Action mailed on Aug. 22, 2024 issued in Japanese Patent Application No. 2021-530244, with English Translation, total 5 pages, citing document 15, therein.

* cited by examiner

EXTRACTOR FOR AN AEROSOL-GENERATING DEVICE

The present specification relates to an aerosol-generating device for use with an aerosol-generating article comprising an aerosol-forming substrate. The aerosol-generating article can be received by the aerosol-generating device. The device includes an extractor for assisting the removal of the aerosol-generating article after consumption.

A number of prior art documents disclose aerosol-generating devices that include, for example, heated smoking systems and electrically heated smoking systems. One advantage of these systems is that they significantly reduce sidestream smoke, while permitting the smoker to selectively suspend and reinitiate smoking. An example of a heated smoking system is disclosed in U.S. Pat. No. 5,144,962, which includes in one embodiment a flavour-generating medium in contact with a heater. When the medium is exhausted, both it and the heater are replaced. An aerosol-generating device where a substrate can be replaced without the need to remove the heating element is desirable.

WO2013/076098 provides a disclosure of an aerosol-generating device having a heater blade that is insertable into the aerosol-forming substrate of an aerosol-generating article and an extractor for facilitating the removal of the aerosol-generating article after use. The aerosol-generating article is an elongated rod consisting of four axially aligned segments; namely, a segment formed from a gathered and folded sheet of tobacco, a support element, an aerosol-cooling element, and a filter segment.

The extractor is a sliding receptacle, which is movably coupled to the aerosol-generating device between a first position and a second position. The first position is an operating position in which the heater blade is inserted into the aerosol-forming substrate, and the second position is an extraction position defined by the aerosol-forming substrate being separated from the heater blade. Therefore, as the extractor is moved to the extraction position after consumption of the aerosol-generating article, the aerosol-forming substrate is pulled off from the heater blade. The aerosol-generating article can then be easily removed from the extractor and device, and discarded.

It would be desirable to provide an extractor arrangement which could allow an aerosol-generating device to be used with other forms of aerosol-generating articles. It would also be desirable to provide an extractor arrangement which could allow a consumer to have a more customisable experience.

According to the present disclosure, there is provided an extractor for extracting an aerosol-forming substrate from an aerosol-generating device. The extractor comprises: a first component configured to connect to the aerosol-generating device. The first component comprises a base and one or more side walls extending from the base to define a cavity for receiving an aerosol-forming substrate. The extractor further comprises: a second component configured to connect to the first component. The second component defines a cylindrical cavity or a circular aperture for receiving a mouthpiece article for the aerosol-generating device.

According to a first aspect of the present invention, there is provided an extractor for extracting an aerosol-forming substrate from an aerosol-generating device, the extractor comprising: a first component configured to connect to the aerosol-generating device, the first component comprising a base and one or more side walls extending from the base to define a cavity for receiving an aerosol-forming substrate. The extractor further comprises a second component configured to connect to the first component. In some embodiments, the second component defines a cavity, preferably a cylindrical cavity, for receiving a mouthpiece article for the aerosol-generating device. The second component may comprise a base and one or more side walls extending from the base to define the cavity or cylindrical cavity. In some embodiments, the second component defines a circular aperture for receiving a mouthpiece article for the aerosol-generating device. In some preferred embodiments of the first aspect of the present invention, the second component comprises a base and one or more side walls extending from the base to define a cylindrical cavity for receiving a mouthpiece article for the aerosol-generating device.

By providing an extractor having the arrangement of the first aspect of the present invention, an aerosol-generating device may be adapted for use with other forms of aerosol-generating articles. In particular, a consumer can place an aerosol-forming substrate, such as loose tobacco, in the cavity of the first component and separately place a mouthpiece article in the cavity of the second component. The consumer can connect the first component to the second component and arrange for the extractor to be connected to an aerosol-generating device. In this way, a consumer is able to use a novel type of aerosol-generating article with the aerosol-generating device. The consumer also has the choice of what type of aerosol-forming substrate they use in the cavity of the first component, as well as what type of mouthpiece article they place in the cavity or aperture of the second component. This can provide the consumer with a more customisable experience. For example, if the consumer has a preference for a certain type of aerosol-forming substrate, such as a certain type of tobacco cut filler, then the present invention provides them with the possibility of using this aerosol-forming substrate with the aerosol-generating device.

The arrangement of the first aspect of the present invention, also allows for a wider range of aerosol-forming substrates to be used with a given type of aerosol-generating device. For example, when an aerosol-generating device is configured for use with an aerosol-generating article that specifically has an aerosol-forming substrate already provided therein, there may be limitations on what that substrate may be. For example, when an aerosol-generating article contains a segment of tobacco that is intended to be penetrated by a heater blade, it may not be feasible for the segment of tobacco to be provided in the form of loose cut filler. Instead, the tobacco may need to be a crimped and gathered sheet in order for the article to be reliably used. With the arrangement of the present invention, it is possible to consume such loose cut filler, because the extractor can provide a compartment in the form of the cavity of the first component for the user to fill.

In some embodiments of the first aspect of the present invention, the second component of the extractor defines a cylindrical cavity for receiving a mouthpiece article for the aerosol-generating device. In this way, a user can insert at least a portion of a mouthpiece article into the cavity to allow the mouthpiece article to be used with the extractor and an associated aerosol-generating device. The mouthpiece article can be held with respect to the extractor by engagement between the outer surface of the mouthpiece article and the surface or surfaces of the second component defining the cavity.

In some embodiments of the first aspect of the present invention, the second component of the extractor defines a circular aperture for receiving a mouthpiece article for the aerosol-generating device. In this way, a user can insert at least a portion of a mouthpiece article into the circular aperture to allow the mouthpiece article to be used with the extractor and an associated aerosol-generating device. The mouthpiece article can be held with respect to the extractor by engagement between the outer surface of the mouthpiece article and the edge of the circular aperture of the second component. When the first component of the extractor is connected to the second component of the extractor, one side of the circular aperture may reside adjacent to the cavity of the first component. The other side of the circular aperture may reside on an external surface of the extractor. Consequently, when the extractor is being used, aerosol may flow from the cavity of the first component through the aperture of the second component to the exterior of the extractor.

The second component may comprise a cap configured to cover one end of the first component. The first end of the first component may comprise an open end of the cavity of the first component. The cap may comprise a cap top wall. The cap top wall may be configured to cover the open end of the cavity of the first component. The circular aperture of the second component may be provided in the cap top wall. The circular aperture may be located in a central region of the cap top wall. The cap of the second component may comprise one or more cap side walls configured to overlie at least a portion of corresponding side walls of the first component. The one or more cap side walls of the second component may be configured to form a snap fit engagement with the corresponding side walls of the first component. The one or more cap side walls of the second component may extend from the cap top wall.

When connected to the aerosol-generating device, the extractor may be configured to slide between a first position and a second position. The first position may be an operating position in which a heating element of the aerosol-generating device is able to heat an aerosol-forming substrate in the cavity of the first compartment to produce an aerosol. The second position may be an extraction position in which the aerosol-forming substrate in the cavity of the first compartment has been moved away from the heating element.

Alternatively or additionally, the extractor may comprise a heating element. For example, the base of the first component of the extractor may comprise a heating element. In such embodiments, the first position may be an operating position in which the heating element of the extractor is able to heat an aerosol-forming substrate in the cavity of the first compartment to produce an aerosol. For example, in the first position, the heating element of the extractor may be configured to receive power from a power supply of the aerosol-generating device. The second position may be an extraction position in which the heating element of the extractor is unable to heat the aerosol-forming substrate in the cavity of the first compartment.

Where the extractor comprises a heating element, the extractor may further comprise electrical contacts electrically connected to the heating element of the extractor. The electrical contacts of the extractor may be configured to form an electrical connection with corresponding electrical contacts on the aerosol-generating device, when the extractor is connected to the aerosol-generating device, and preferably when the extractor is in the first position.

Alternatively or additionally, where the extractor comprises a heating element, the heating element may comprise a susceptor element. The susceptor element may be configured to receive power from an inductor in the aerosol-generating device, when the extractor is connected to the aerosol-generating device, and preferably when the extractor is in the first position. The inductor may comprise an inductor coil and a power source connected to the inductor coil. The power source may be configured to provide a high frequency electric current to the inductor coil such that, in use, the inductor coil generates a fluctuating electromagnetic field to heat the susceptor element and thereby heat aerosol-forming substrate in the cavity of the first component of the extractor.

The heating element may comprise a portion having a generally serpentine shape. For example, the heating element may comprise a strip, which meanders between a first point and a second point. The strip may have a first set of lobes and a second set of lobes, where the apex of each first lobe is generally opposite the apex of a corresponding second lobe. The strip may be a susceptor element. The strip may be a piece of electrically resistive wire.

To use the extractor of the first aspect of the present invention, a user may first place the extractor in the first or second position. The user may then fill the cavity of the first component of the extractor with an aerosol-forming substrate, such as loose cut filler. The user may then attach the second component of the extractor to the first component and place at least a portion of a mouthpiece article in the cavity or aperture of the second component. If the extractor is in the second position, then the user may then move the extractor to the first position. The user may then activate the heating element to produce an aerosol and consume the aerosol. When the user has finished consumption, the user may then move the extractor to the second position. When in the second position, the user may detach the second component of the extractor from the first component of the extractor, and remove the used aerosol-forming substrate from the cavity of the first component. The user may also remove the mouthpiece article which has been placed in the cavity or aperture of the second component. The user may then repeat this process with a new aerosol-forming substrate and new mouthpiece article. Alternatively, the user may re-use the mouthpiece article.

The one or more side walls of the first component preferably consist of a single side wall extending from the base of the first component. Alternatively, the first component may have between three and six side walls, each of which extend from a different portion of the base of the first component.

The one or more side walls of the first component preferably extend around the entire periphery of the base of the first component. More preferably, the first component has a single cylindrical side wall, which extends around the entire periphery of the base of the first component.

The one or more side walls of the second component preferably consist of a single side wall extending from the base of the second component. Alternatively, the second component may have between three and six side walls, each of which extend from a different portion of the base of the second component.

The one or more side walls of the second component preferably extend around the entire periphery of the base of the second component. More preferably, the second component has a single cylindrical side wall, which extends around the entire periphery of the base of the second component.

In some embodiments, each side wall of the first component has a first end proximate to the base of the first component, and a second end distal from the base of the first component. In such embodiments, when the second component is connected to the first component and the second component comprises a base, the base of the second component may be positioned adjacent to the second end of the one or more side walls of the first component. In some embodiments, when the second component is connected to the first component, the base of the second component may close the cavity for receiving an aerosol-forming substrate. Alternatively, when the second component is connected to the first component and the second component comprises a cap top wall, the cap top wall of the second component may be positioned adjacent to the second end of the one or more side walls of the first component. This may advantageously retain any aerosol-forming substrate within the cavity of the first compartment prior to, or during use of the aerosol-generating device.

The base of the first component may comprise at least one aperture. The at least one aperture may be sized and shaped to allow a heating element of the aerosol-generating device to extend into the cavity of the first component when the extractor is connected to the aerosol-generating device. In some embodiments, the base of the first component has a single aperture located centrally in the base. The single aperture may both permit air to flow into the cavity and allow a heating element of the aerosol-generating device to extend into the cavity of the first component when the extractor is connected to the aerosol-generating device.

The base of the first component may further comprise at least one sheath extending into the cavity of the first component, with each sheath extending from a respective one of the at least one apertures. The sheath may serve to protect a heating element which has been inserted into the cavity through the sheath's respective aperture. The sheath may prevent the heating element from coming into direct contact with any aerosol-forming substrate in the cavity. This may help to keep the heating element clean.

The sheath may have a first end disposed at the aperture from which the sheath extends, and an opposed second end. The second end of the sheath may be open.

Alternatively, the second end of the sheath may be closed. This can prevent the tip of the heating element from coming into direct contact with any aerosol-forming substrate present in the cavity.

The sheath may comprise a thermally conductive material, this may advantageously facilitate transfer of heat from a heating element to an aerosol-forming substrate received within the cavity. For example, the sheath may comprise a material having a thermal conductivity—measured at 20 degree Celsius—of at least 5 W/(m*K) (Watt per meter and per Kelvin), in particular of at least 10 W/(m*K) (Watt per meter and per Kelvin), preferably of at least 50 W/(m*K) (Watt per meter and per Kelvin), more preferably of at 100 W/(m*K) (Watt per meter and per Kelvin), even more preferably of at least 150 W/(m*K) (Watt per meter and per Kelvin), most preferably of at least 200 W/(m*K) (Watt per meter and per Kelvin). The sheath may comprise a metallic material such as a pure metal or an alloy. For example, the sheath may comprise or be formed from at least one of: aluminum, copper, nickel, iron, platinum, gold, or alloys of such metals.

The height of the one or more side walls of the first component may be greater than the height of the one or more side walls of the second component. This may help to keep the overall height of the extractor within a desired range, whilst also allowing for sufficient space for housing an aerosol-forming substrate in the cavity of the first component. The height of the one or more side walls of the first component may be at least 1.5 times greater than the height of the one or more side walls of the second component. For example, the height of the one or more side walls of the first component may be at least 2.0 or 2.5 times greater than the height of the one or more side walls of the second component.

The height of the one or more side walls of the first component may be between about 5 millimetres and about 20 millimetres, preferably between about 10 millimetres and about 15 millimetres. The height of the one or more side walls of the first component may be about 12 millimetres.

The height of the one or more side walls of the second component may be selected to be large enough to ensure a mouthpiece article is retained in the cylindrical cavity by an interference fit when in use. For example, the height of the one or more side walls of the second component may be at least about 1 millimetre.

The height of the one or more side walls of the second component may be selected to be small enough to ensure a user's mouth or lips do not come into contact with the one or more side walls of the second component when in use. For example, the height of the one or more side walls of the second component may be no more than about 5 millimetres.

The height of the one or more side walls of the second component may be between about 1 millimetre and about 5 millimetres.

The first component is preferably configured to allow air to flow into the cavity of the first component. Where one or more apertures are provided on the base of the first component, at least one of these apertures may be configured to allow air to flow into the cavity of the first component. Alternatively or additionally, the one or more side walls of the first component may be provided with one or more apertures for allowing air to flow into the cavity of the first component. Such one or more apertures are preferably provided in the first end of the one or more side walls proximate to the base of the first component.

When the second component is connected to the first component a chamber may be formed in the first component, the chamber being delimited by the base of the first component, the one or more side walls of the first component, and the base of the second component.

The extractor may be provided with means for allowing air to escape such a chamber. Therefore, preferably, the base of the second component comprises at least one air permeable portion. The at least one air permeable portion can allow airflow to exit the chamber and pass on to the mouth of a consumer. Preferably, the entire base of the second component is formed of an air permeable structure.

The at least one air permeable portion may be provided in the form of a mesh formed in the base of the second component. The mesh may comprises an array of filaments. The mesh may be woven or non-woven. The mesh may be formed using different types of weave or lattice structures. Preferably, the mesh has a plain weave design.

The mesh may have a mesh density of between about 5 and about 25 filaments per centimetre (+/−10 percent). Advantageously, a mesh density within this range has been found to retain the aerosol-forming substrate in the cavity without increasing the resistance to draw of the aerosol-generating article.

The mesh may be formed of any suitable material, such as plastics, ceramics, metals, or any combination thereof. Preferably, the mesh may be formed from food grade stainless steel.

The first component may be attached to the second component by any suitable attachment mechanism. For example, the first component may be configured to attach to the second component by a snap-fit engagement, an interference fit engagement, or a magnetic engagement.

In some embodiments, the first component and the second component each comprise a co-operating screw thread for connecting the first component to the second component. For example, an outer surface of the first component may be provided with a first thread, and an inner surface of the second component may be provided with a corresponding second thread.

The extractor arrangement of the first aspect of the present invention can advantageously allow for a consumer to assemble their own aerosol-generating article in a device which is configured to heat, but not burn, an aerosol-forming substrate to produce an aerosol. This novel arrangement can advantageously allow a user to customise their experience. Different users have different preferences. The cavity of the first component should therefore be sized to allow a consumer to choose how much aerosol-forming substrate they wish to include in the extractor. The inner surface of at least one side wall of the first compartment may be provided with a marking. This can advantageously help a user to decide how much aerosol-forming substrate to include.

Accordingly, according to a second aspect of the present invention, there is provided an extractor for extracting an aerosol-forming substrate from an aerosol-generating device, the extractor being configured to connect to the aerosol-generating device and comprising: a base and one or more side walls extending from the base, wherein each side wall has an inner surface defining a cavity for receiving an aerosol-forming substrate; and wherein the at least one side wall is provided with a marking. Providing such a marking can advantageously help a user to decide how much aerosol-forming substrate to include in the extractor. The marking may be provided on one or both of the inner surface and the outer surface of the at least one side wall. Providing the marking on the inner surface of the at least one side wall can allow a user to see exactly whether they have filled the cavity to a level indicated by the marking. In some embodiments, the at least one side wall may be transparent. In such embodiments, the marking may be provided within the side wall, since the transparency of the side wall can allow a user to see the marking. The transparent side wall may also allow a user to see the marking from both sides of the side wall, irrespective of whether the marking is provided on the inner surface or the outer surface of the side wall.

In the second aspect of the present invention, there is not a requirement for a second component that should be attached to a first component. Instead, after a user has used the marking to insert a suitable amount of aerosol-forming substrate into the cavity, the user may then directly insert one end of a mouthpiece article into the same cavity. The height of the one or more side walls of the extractor should therefore preferably be sized to accommodate both an aerosol-forming substrate and a portion of a mouthpiece article.

In the second aspect of the present invention, the one or more side walls of the extractor preferably consist of a single side wall extending from the base of the extractor. Alternatively, the extractor may have between three and six side walls, each of which extend from a different portion of the base of the extractor. The one or more side walls of the extractor preferably extend around the entire periphery of the base of the extractor. More preferably, the extractor has a single cylindrical side wall, which extends around the entire periphery of the base of the extractor.

Preferably, each side wall of the extractor has a first end proximate to the base, and a second end distal from the base, and the marking is provided between the first and second ends of its respective side wall.

Preferably, the side wall of the extractor having the marking has a height defined by the distance between the first end of the side wall and the second end of the side wall, and the marking is spaced from the base by a distance of between about 50 percent and 90 percent of the height of the side wall. This can provide an appropriate division of the space within the cavity for the aerosol-forming substrate and for the end of the mouthpiece article.

The marking may be positioned on only one portion of the periphery of the cavity. The marking may be positioned on only one wall of the extractor. Preferably, the marking extends around the entire perimeter of the cavity. This can help the user to see the marking no matter across a full 360 degree viewing range.

The marking may form all or part of an indicia. As used herein, "indicia" refers to a discrete visual element or relating element or pattern. The indicia may be in the form of text, images, letters, words, logos, patterns or a combination thereof. The marking may be provided on the inner surface of the one or more side walls by any suitable means, such as one or more of printing and engraving. The marking may provide a visual aid to inform a consumer about how much aerosol-forming substrate they should provide in the cavity.

Preferably, the marking comprises at least one line. Preferably, the at least one line is a dotted line. In some embodiments, marking may comprise a first line and a second line spaced from the first line. The first and second lines may be parallel to one another. The first line may be used to indicate a first fill level, and the second line may be used to indicate a second fill level. The indicia may suggest which fill level should be used based on the desired user experience or the type of aerosol-forming substrate used.

The extractor may have a longitudinal axis extending through the base of the extractor. Where the marking comprises at least one line, preferably the at least one line extends along the side of the cavity in a direction perpendicular to the longitudinal axis.

The base of the extractor of the second aspect of the invention may comprise at least one aperture. The at least one aperture may be sized and shaped to allow a heating element of the aerosol-generating device to extend into the cavity of the extractor when the extractor is connected to the aerosol-generating device. In some embodiments, the base of the extractor has a single aperture located centrally in the base. The single aperture may both permit air to flow into the cavity and allow a heating element of the aerosol-generating device to extend into the cavity of the extractor when the extractor is connected to the aerosol-generating device.

The base of the extractor of the second aspect of the invention may further comprise at least one sheath extending into the cavity for receiving an aerosol-forming substrate, with each sheath extending from a respective one of the at least one apertures. The sheath may serve to protect a heating element which has been inserted into the cavity through the sheath's respective aperture. The sheath may prevent the heating element from coming into direct contact with any aerosol-forming substrate in the cavity. This may help to keep the heating element clean.

The sheath may have a first end disposed at the aperture from which the sheath extends, and an opposed second end. The second end of the sheath may be open. Alternatively, the second end of the sheath may be closed. This can prevent the tip of the heating element from coming into direct contact with any aerosol-forming substrate present in the cavity.

The extractor of the first and second aspects of the invention may be configured to attach to an aerosol-generating device. Therefore, according to a third aspect of the present invention there is provided an aerosol-generating device comprising: a body having a first end and a second end, the first end defining a device cavity for receiving an aerosol-generating article; a heating element disposed in the device cavity; and an extractor configured to connect to the first end of the body of the aerosol-generating device, the extractor being in accordance with one or both of the first and second aspects of the invention.

The aerosol-generating device is a device that is configured to heat an aerosol-forming substrate to generate an aerosol. The aerosol-generating device may comprise one or more components used to supply energy from a power supply to the aerosol-forming substrate to generate the aerosol. For example, the aerosol-generating device may be a heated aerosol-generating device. The aerosol-generating device may be an electrically heated aerosol-generating device or a gas-heated aerosol-generating device. The aerosol-generating device may be a smoking device that heats an aerosol-forming substrate to generate an aerosol that is directly inhalable into a user's lungs thorough the user's mouth. The aerosol-generating device may be a holder for an aerosol-generating article.

The heating element may be part of an electric heater or electric heater assembly.

The aerosol-generating device may comprise a power supply for supplying power to the electric heater. The power supply may be any suitable power supply, for example a DC voltage source. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate or a Lithium-Polymer battery.

The aerosol-generating device may further comprise electronic circuitry arranged to be connected to the power supply and the electric heater. If more than one heating element is provided, the electronic circuitry may provide for the heating elements to be independently controllable. The electronic circuitry may be programmable.

In one embodiment, the aerosol-generating device further comprises a sensor to detect air flow indicative of a user taking a puff which enables puff based activation of the electric heater or an improved energy management of the electric heater. The sensor may be any of: a mechanical device, an electro-mechanical device, an optical device, an opto-mechanical device and a micro electro-mechanical systems (MEMS) based sensor. In that embodiment, the sensor may be connected to the power supply and the system is arranged to activate the electric heater when the sensor senses a user taking a puff. In an alternative embodiment, the aerosol-generating device further comprises a manually operable switch, for a user to initiate a puff or to enable a long-lasting smoking experience.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support.

Preferably, the aerosol-forming substrate comprises plant material and an aerosol former. Preferably, the plant material is a plant material comprising an alkaloid, more preferably a plant material comprising nicotine, and more preferably a tobacco-containing material.

Preferably, the aerosol-forming substrate comprises at least 70 percent of plant material, more preferably at least 90 percent of plant material by weight on a dry weight basis. Preferably, the aerosol-forming substrate comprises less than 95 percent of plant material by weight on a dry weight basis, such as from 90 to 95 percent of plant material by weight on a dry weight basis.

Preferably, the aerosol-forming substrate comprises at least 5 percent of aerosol former, more preferably at least 10 percent of aerosol former by weight on a dry weight basis. Preferably, the aerosol-forming substrate comprises less than 30 percent of aerosol former by weight on a dry weight basis, such as from 5 to 30 percent of aerosol former by weight on a dry weight basis.

In some particularly preferred embodiments, the aerosol-forming substrate comprises plant material and an aerosol former, wherein the substrate has an aerosol former content of between 5% and 30% by weight on a dry weight basis. The plant material is preferably a plant material comprising an alkaloid, more preferably a plant material comprising nicotine, and more preferably a tobacco-containing material. Alkaloids are a class of naturally occurring nitrogen-containing organic compounds. Alkaloids are found mostly in plants, but are also found in bacteria, fungi and animals. Examples of alkaloids include, but are not limited to, caffeine, nicotine, theobromine, atropine and tubocurarine. A preferred alkaloid is nicotine, which may be found in tobacco.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco. The aerosol-forming substrate may comprise both solid and liquid components. The aerosol-forming substrate may comprise a tobacco-containing material containing volatile tobacco flavour compounds, which are released from the substrate upon heating. The aerosol-forming substrate may comprise a non-tobacco material. The aerosol-forming substrate may further comprise an aerosol former. Examples of suitable aerosol formers are glycerine and propylene glycol.

The aerosol-forming substrate may comprise one or more of reconstituted tobacco, cast leaf tobacco, shredded tobacco, gathered sheet tobacco, stem tobacco, expanded tobacco, or loose cut filler.

Cut filler tobacco products for smoking articles are formed predominantly from the lamina portion of the tobacco leaf, which is separated from the stem portion of the leaf during a threshing process. Much of the stem portion that remains after the lamina has been removed and separated is not used. However, it is not uncommon to add some tobacco stems back into the cut filler together with the lamina.

According to a fourth aspect of the present invention, there is provided a mouthpiece article comprising: a rod comprising a filter segment and an aerosol-cooling element, wherein the rod has a first end having an end face and an opposed second end having an end face, and wherein the end face of the first end of the rod is defined by the filter segment and the end face of the second end of the rod is defined by the aerosol-cooling element.

In contrast to existing aerosol-generating articles, which are intended to be heated but not combusted to form an aerosol, the mouthpiece article of the fourth aspect of the present invention does not include an aerosol-forming substrate. Instead, the mouthpiece article may be considered in some embodiments to correspond to the structure of such an existing aerosol-generating articles without the aerosol-forming substrate. The upstream, or second end of the mouthpiece article is therefore not defined by an aerosol-forming substrate. Instead, it is defined by an aerosol-cooling element. Such a novel article can advantageously be used with extractors according to the first of second aspects of the present invention to enable a consumer to assemble their own aerosol-generating article in a device which is configured to heat, but not burn, an aerosol-forming substrate to produce an aerosol.

The mouthpiece article comprises a filter segment. Preferably, the filter segment is located at the mouth end of the rod. Preferably the filter segment is in the form of a plug. Preferably, the filter segment comprise fibres. Preferably, the fibres of the filter segment comprise cellulose acetate.

Preferably, the filter segment has a resistance to draw of from about 0.4 mm $H_2O$ to about 3 mm $H_2O$ per millimetre length. Preferably, the aerosol-generating article has a total resistance to draw of from about 0.6 mm $H_2O$ to about 1.5 mm $H_2O$ per millimetre length, more preferably of from about 0.8 mm $H_2O$ to about 1.2 mm $H_2O$ per millimetre length.

The mouthpiece article comprises an aerosol-cooling element. The aerosol-cooling element may help to cool aerosol produced by an aerosol-forming substrate placed in the extractor. The aerosol-cooling element therefore refers to a component of a mouthpiece article, which in use will be located downstream of an aerosol-forming substrate such that, in use, an aerosol formed by volatile compounds released from the aerosol-forming substrate passes through and is cooled by the aerosol cooling element before being inhaled by a user. An aerosol cooling element has a large surface area, but causes a low pressure drop. Filters and other mouthpieces that produce a high pressure drop, for example filters formed from bundles of fibres, are not considered to be aerosol-cooling elements. Chambers and cavities within an aerosol-generating article are not considered to be aerosol cooling elements.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. The plurality of longitudinally extending channels may be defined by multiple sheets that have been one or more of crimped, pleated, gathered and folded to form multiple channels.

As used herein, the term 'sheet' denotes a laminar element having a width and length substantially greater than the thickness thereof.

As used herein, the term 'longitudinal direction' refers to a direction extending along, or parallel to, the cylindrical axis of a rod.

As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod.

As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

The aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

Preferably, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 mm2/mg.

The filter segment which defines the first end of the rod may directly abut the aerosol-cooling element which defines the second end of the rod. Alternatively, one or more additional mouthpiece article segments may be disposed between the filter segment and the aerosol-cooling element. Such additional mouthpiece article segments may be one or more of a cavity, a hollow acetate tube, and a filter plug.

As used herein, the term 'rod' is used to denote a generally cylindrical element of substantially circular, oval or elliptical cross-section.

It will be appreciated that preferred features described above in relation to one aspect of the invention may also be applicable to other aspects of the invention. For example, preferred features of the extractor of the first aspect of the invention may also be included in the extractor of the second aspect of the invention, and vice versa. That is, the extractor of the first aspect of the invention may have the marking of the second aspect of the invention, and any of its preferred features. Said marking may be provided on the first component of the extractor. Furthermore, the extractor of the second aspect of the invention may have the two component structure of the first aspect of the present invention, and any of their preferred features.

Embodiments of the invention will now be described, by way of example only, with reference to the accompanying drawings, in which.

Figure 1:
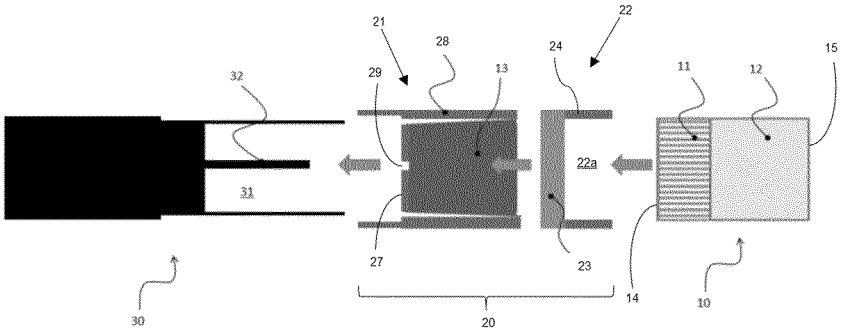
FIGS. 1 to 4 show schematic representations of an aerosol-generating device, an extractor and a mouthpiece article in accordance with a first embodiment of the invention.

FIG. 1 shows an elongate aerosol-generating device 30 having a cavity 31 at a first end. The cavity contains an elongate heating element in the form of a heating blade 32. Although not visible in FIG. 1, the heating element is an electrically resistive heating element 32, which is electrically connected to an electrical power supply within the device 30.

Adjacent to the first end of the device 30 is an extractor 20. The extractor 20 consists of two components; a first component 21 and a second component 22. The first component 21 is arranged to connect to the first end of the device, and comprises a base 27 and a single cylindrical side wall 28 extending from the base 27. The base 27 and the side wall 28 define an internal cavity within the first component. As shown in FIG. 1, this cavity is filled with a charge of aerosol-forming substrate 13 in the form of loose shredded tobacco material.

The second component 22 is arranged to connect to the first component 21, and comprises a base 23 and a cylindrical side wall 24 extending from the base. These define a cavity 22*a* in the second component. This cavity 22*a* is arranged to receive a mouthpiece article 10, which is shown in FIG. 1 adjacent to the second component 22. The base 23 of the second component 22 is formed of an air permeable mesh.

The side walls 28 of the first component also extend beyond the base 27 of the first component 21 to assist with attaching the first component 21 to the device 30.

Figure 2:
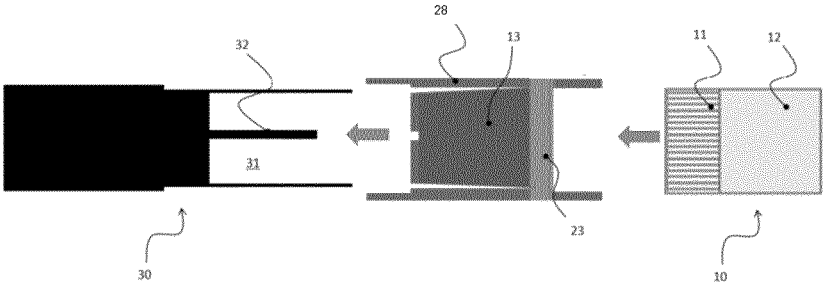
Figure 3:
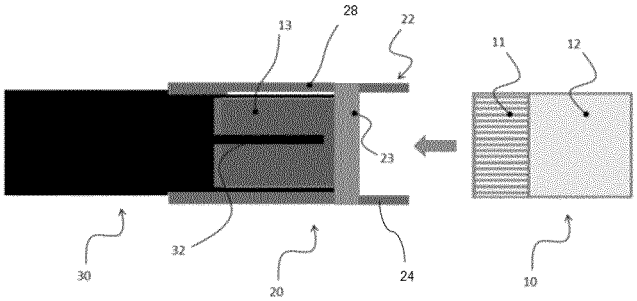
Figure 4:
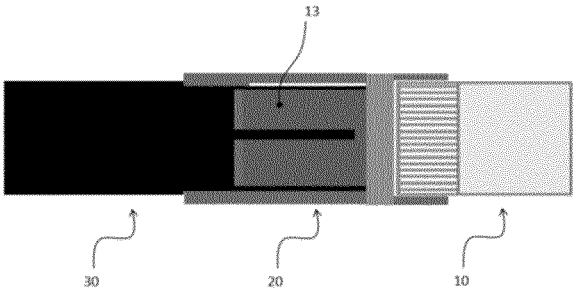

In FIG. 1, the system is in a fully unassembled condition. In FIG. 2, the first component 21 and second component 22 of the extractor 20 have been connected to one another. In FIG. 3, the extractor 20 has been connected to the aerosol-generating device 30. In this position, the heating element 32 has been inserted into through a hole 29 in the base 27 of the first component 21 so that the heating element may extend into the cavity of the first component 21 and transfer heat to the aerosol-forming substrate 13 contained therein. Finally, in FIG. 4, the mouthpiece article 10 has been inserted into the cavity 22*a* of the second component. In use, a user draws on the mouth end filter 12 of the mouthpiece article 10. This causes air to enter the assembly through an air inlet (not shown) in the aerosol-generating device 30. The air then passes through the aperture 29 in the base of the first component and into the cavity of the first component 21. The heating element 32 heats the aerosol-forming substrate 13 in the cavity of the first component 21 to form an aerosol, which is drawn by the incoming air towards the air permeable base 23 of the second component 22. The aerosol then passes into the cavity 22*a* of the second component, in which the aerosol-cooling element 11 is located. The aerosol is cooled as it passes through the aerosol-cooling element, and then subsequently passes through mouth end filter element 12 before being inhaled by the user.

When the user has finished using the assembly, they can remove the mouthpiece article 10 from the cavity 22*a* of the second component 22 of the extractor 20. The mouthpiece article 10 can be discarded or kept for reuse. The user then pulls the extractor away from the device 30 to the position shown in FIG. 2. It should be noted that: although FIG. 2 shows the extractor 20 as having been fully detached from the device 30, this need not be the case. Instead, the extractor 20 may remain attached to the device 30, but in an extended position, whereby the heating element 32 has been pulled out of the cavity of the first component 21. This process can help to pull away any aerosol-forming substrate 13, which has become stuck to the heating element, and thus help to keep the heating element 32 clean. Once the extractor has been detached from the device 30 or moved to its extended position, the first component 21 can be detached from the second component 22 and the consumed aerosol-forming substrate 13 can be removed from the cavity of the first component 21. The extractor is then ready for further use with a new charge of aerosol-forming substrate 13.

FIGS. 5 to 8 show schematic representations of an aerosol-generating device, an extractor and a mouthpiece article in accordance with a second embodiment of the invention, through various stages of use. The extractor of the second embodiment functions in a similar manner to the extractor of the first embodiment. However, as can be seen from FIG. 5, the extractor 20 of the second embodiment does not have first and second components, but instead is formed as a single component 20. The single component 20 has a base 23 and a single cylindrical side wall 28 extending from the base, which together define a cavity for receiving an aerosol-forming substrate 13. The base 23 of the extractor 20 has an aperture 29 so that the heating element 32 may extend into the cavity 21*a* of the extractor 20. The inner surface of the cylindrical side wall 28 is provided with a marking 26 in the form of a dotted line which extends around the entire periphery of the cavity. The dotted line 26 extends perpendicular to the longitudinal axis of the extractor 20. The dotted line 26 can provide a user with a visual indication of a fill level that they should seek to achieve.

Figure 5:
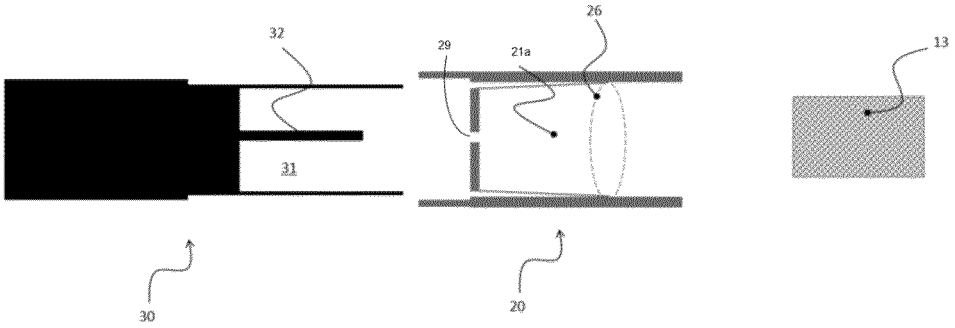
FIGS. 5 to 8 show schematic representations of an aerosol-generating device, an extractor and a mouthpiece article in accordance with a second embodiment of the invention.
Figure 6:
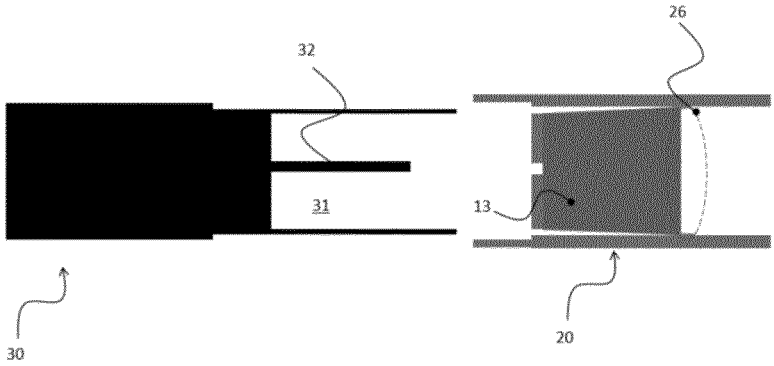
Figure 7:
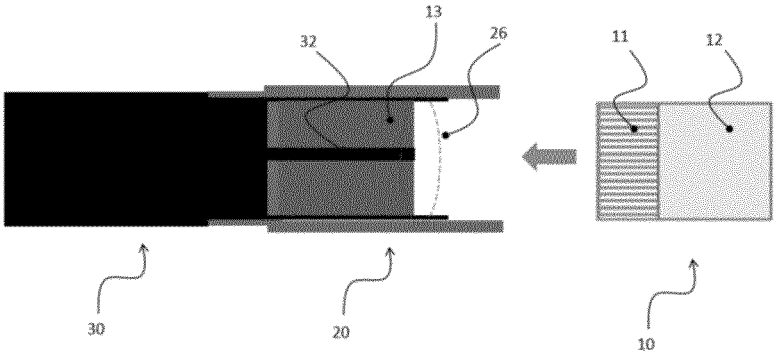
Figure 8:
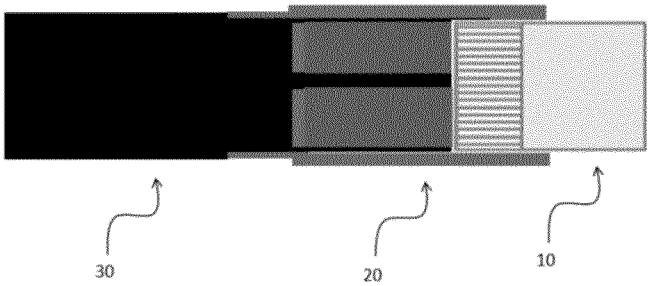

In FIG. 5, the cavity 21*a* is empty with a charge of tobacco 13 being ready for insertion into the cavity 21*a*. In FIG. 6, the cavity 21*a* has been filled with the charge of tobacco 13, and has a fill level corresponding to the dotted line 26. In FIG. 7, the extractor 20 has been attached to the device 30 and the heating element 32 extends through the aperture 29 in the base 27 of the extractor 20. In FIG. 8, a mouthpiece article 10 has been inserted into the portion of the cavity 21*a* that is not filled by the tobacco 13. In this configuration, the assembly is ready for a consumer to use.

Figure 9:
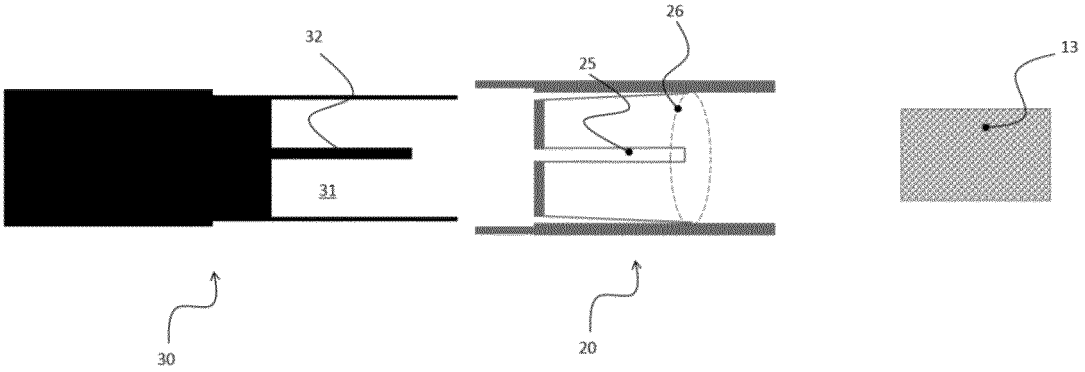
FIG. 9 shows a schematic representation of an aerosol-generating device, an extractor and an aerosol-forming substrate in accordance with a third embodiment of the invention.
Figure 10:
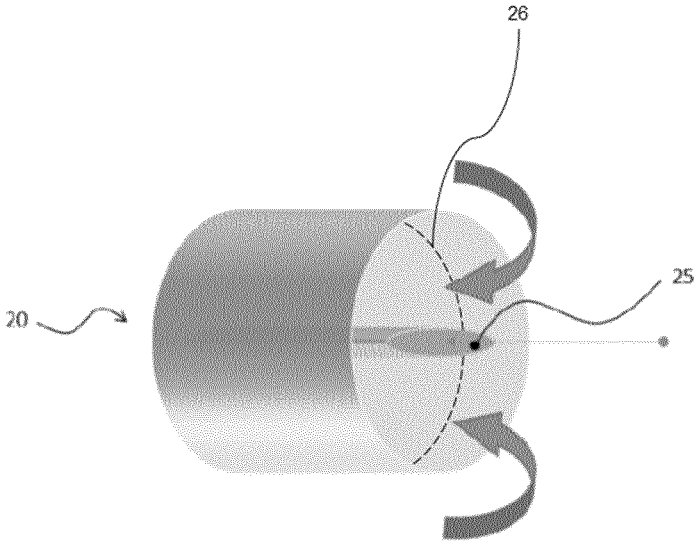
FIG. 10 shows a perspective view of the extractor of FIG. 9.

FIG. 9 shows a schematic representation of an aerosol-generating device, an extractor and an aerosol-forming substrate in accordance with a third embodiment of the invention. The arrangement of FIG. 9 corresponds to that of the second embodiment in FIG. 5, with the exception of the extractor 20 now comprising a sheath 25 extending into the cavity 21*a*. The sheath 25 extends from the aperture 29 in the base 27 of the extractor 20. The sheath 25 is configured to enclose the heating element 32 when the heating element 32 is inserted into the cavity 21*a* of the extractor 20. The sheath 25 can serve to protect the heating element 32. The sheath 25 can also prevent the heating element 32 from coming into direct contact with any aerosol-forming substrate in the cavity 21*a*. This may help to improve the cleanliness of the heating element 32. A perspective view of the extractor of the third embodiment can be seen in FIG. 10.

Figure 11:
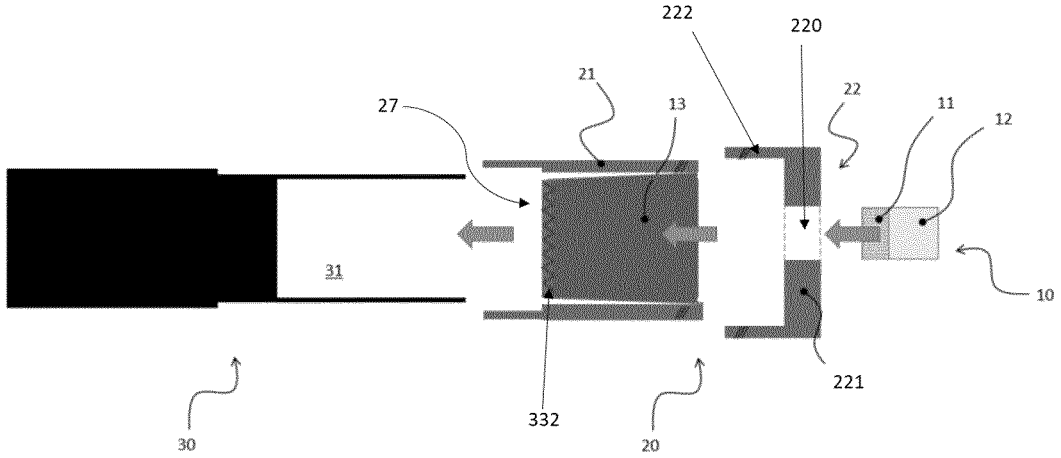
FIG. 11 shows a schematic representation of an aerosol-generating device, an extractor, an aerosol-forming substrate and a mouthpiece article in accordance with a fourth embodiment of the invention.

FIG. 11 shows a schematic representation of an aerosol-generating device 30, an extractor 20, an aerosol-forming substrate 13 and a mouthpiece article 10 in accordance with a fourth embodiment of the invention. The arrangement of FIG. 11 corresponds to that of the first embodiment in FIG. 1. However, in the embodiment of FIG. 11, the second component 22 of the extractor 20 now comprises a circular aperture 220 instead of a cavity 22*a*. In particular, the second component 22 of the extractor 20 is now in the form of a cap, which forms a snap-fit engagement with the first component 21 and covers the open end of the cavity of the first component 21. The cap 22 comprises a cap top wall 221 comprising the circular aperture 220. The cap also comprises a cylindrical cap side wall 222, which is configured to overlie the cylindrical side wall of the first component 21.

The mouthpiece article 10 in FIG. 11 only consists of a mouth end filter 12 and a cooling element 11. The circular aperture 220 of the extractor 20 is configured to receive the mouthpiece article 10 as shown by the arrow in FIG. 11.

Figure 12:
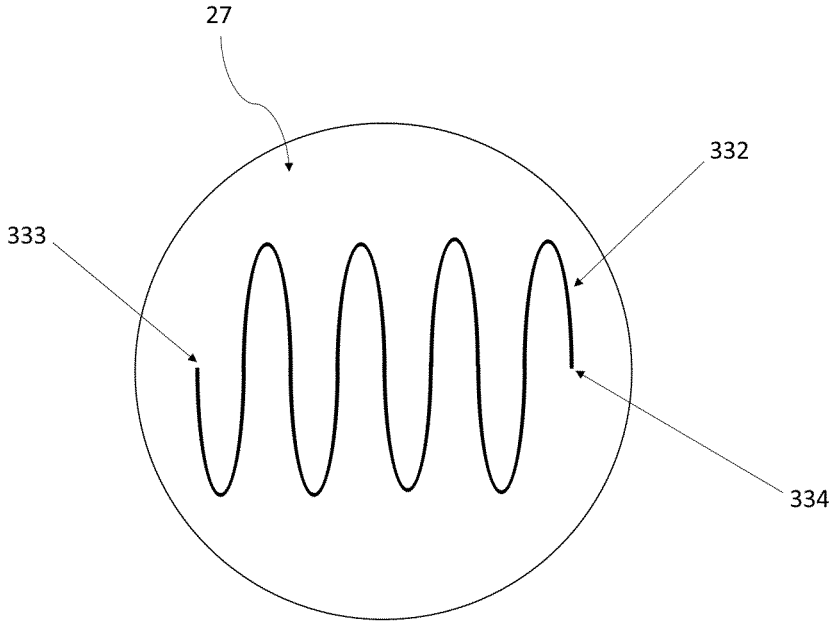
FIG. 12 shows a plan view of a portion of the extractor of FIG. 11.

The extractor of the fourth embodiment in FIG. 11 also differs from the extractor of the first, second and third embodiments, in that the base 27 of the first component 21 comprises a heating element 332. As best seen from the plan view in FIG. 12, the heating element 332 has a generally serpentine shape, extending across the surface of the base 27. In particular, the heating element comprises a strip 332, which meanders between a first point 333 and a second point 334 across the base 27 of the first component 21.

The invention claimed is:

1. An extractor for extracting an aerosol-forming substrate from an aerosol-generating device, the extractor comprising:

a first component configured to connect to the aerosol-generating device, the first component comprising a base and one or more side walls extending from the base to define a cavity configured to receive an aerosol-forming substrate; and a second component configured to connect to the first component, the second component defining a cylindrical cavity or a circular aperture configured to receive a mouthpiece article for the aerosol-generating device.

2. The extractor according to claim 1, wherein the second component comprises a base and one or more side walls extending from the base to define the cylindrical cavity, wherein each side wall of the one or more side walls of the first component has a first end proximate to the base of the first component, and a second end distal from the base of the first component, and wherein, when the second component is connected to the first component, the base of the second component is disposed adjacent to the second end of the one or more side walls of the first component.

3. The extractor according to claim 1, wherein each side wall of the one or more side walls of the first component has a first end proximate to the base of the first component, and a second end distal from the base of the first component defining an open end of the cavity of the first component, wherein the second component comprises a cap configured to cover the open end of the cavity of the first component, the cap comprising a cap top wall having the aperture, and wherein, when the second component is connected to the first component, the cap top wall of the second component is disposed adjacent to the second end of the one or more side walls of the first component.

4. The extractor according to claim 1, wherein the base of the first component comprises at least one aperture configured to allow a heating element of the aerosol-generating device to extend into the cavity of the first component when the extractor is connected to the aerosol-generating device.

5. The extractor according to claim 4, wherein the base of the first component further comprises at least one sheath extending into the cavity of the first component, the at least one sheath extending from a respective one of the at least one aperture.

6. The extractor according to claim 1, wherein the base of the first component of the extractor comprises a heating element.

7. The extractor according to claim 6, wherein the heating element comprises a portion having a generally serpentine shape.

8. The extractor according to claim 1, wherein the first component and the second component each comprise a cooperating screw thread configured to connect the first component to the second component.

9. An aerosol-generating device, comprising:

a body having a first end and a second end, the first end defining a device cavity configured to receive an aerosol-generating article;

a heater component disposed in the device cavity; and an extractor according to claim 1, wherein the extractor is configured to connect to the first end of the body of the aerosol-generating device.

10. A system, comprising:

an extractor according to claim 1; and a mouthpiece article for the extractor, the mouthpiece article comprising a rod comprising a filter segment and an aerosol-cooling element, wherein the rod has a first end having an end face and an opposed second end having an end face, and wherein the end face of the first end of the rod is defined by the filter segment and the end face of the second end of the rod is defined by the aerosol-cooling element.

11. An extractor for extracting an aerosol-forming substrate from an aerosol-generating device, the extractor being configured to connect to the aerosol-generating device and comprising:

a base and one or more side walls extending from the base, wherein each side wall of the one or more side walls has an inner surface defining a cavity configured to receive an aerosol-forming substrate, wherein said each side wall is provided with a marking, wherein the marking may form all or part of an indicia and/or comprise at least one line, and wherein the marking extends around an entire perimeter of the cavity.

12. The extractor according to claim 11, wherein said each side wall of the one or more side walls of the first component has a first end proximate to the base, and a second end distal from the base, and wherein the marking is provided between the first and the second ends of the respective said each side wall.

13. The extractor according to claim 12, wherein said each side wall having the marking has a height defined by a distance between the first end and the second end, and wherein the marking is spaced from the base by a distance of between about 50 percent and 90 percent of a height of said each side wall.

14. An extractor for extracting an aerosol-forming substrate from an aerosol-generating device, the extractor being configured to connect to the aerosol-generating device and comprising:

a base and one or more side walls extending from the base, wherein each side wall of the one or more side walls has an inner surface defining a cavity configured to receive an aerosol-forming substrate, wherein said each side wall is provided with a marking, wherein the marking may form all or part of an indicia and/or comprise at least one line, and wherein the marking comprises a dotted line.

15. The extractor according to claim 14, wherein said each side wall of the one or more side walls has a first end proximate to the base, and a second end distal from the base, and wherein the marking is provided between the first and the second ends of the respective said each side wall.

16. The extractor according to claim 14, wherein said each side wall having the marking has a height defined by a distance between the first end and the second end, and wherein the marking is spaced from the base by a distance of between about 50 percent and 90 percent of a height of said each side wall.

* * * * *